US006480081B1

(12) United States Patent
Nakamura

(10) Patent No.: US 6,480,081 B1
(45) Date of Patent: Nov. 12, 2002

(54) SHOCK SENSOR

(75) Inventor: Kiyotaka Nakamura, Tokyo (JP)

(73) Assignee: Oki Electric Industry Co., Ltd. (JP)

( * ) Notice: Subject to any disclaimer, the term of this patent is extended or adjusted under 35 U.S.C. 154(b) by 438 days.

(21) Appl. No.: 09/008,071

(22) Filed: Jan. 16, 1998

(30) Foreign Application Priority Data

Jan. 30, 1997 (JP) ..... 9-017125

(51) Int. Cl.[7] ..... H01H 1/66
(52) U.S. Cl. ..... 335/151; 335/207
(58) Field of Search ..... 335/151, 152, 335/153, 154, 156, 157, 205.7; 200/61.45 R, 61.53

(56) References Cited

U.S. PATENT DOCUMENTS 2,976,378 A 3/1961 Goddard
3,089,010 A * 5/1963 Koda
3,128,356 A * 4/1964 Lychyk et al.
3,265,825 A * 8/1966 Barton
3,293,578 A * 12/1966 Else ..... 335/154
4,156,218 A * 5/1979 Koppensteiner ..... 335/153
4,980,526 A * 12/1990 Reneau ..... 200/61.45 M
5,440,084 A * 8/1995 Fuse et al. ..... 200/61.45

FOREIGN PATENT DOCUMENTS

DE 88 06 240.6 8/1988
FR 2366683 4/1978

* cited by examiner

*Primary Examiner*—Lincoln Donovan
(74) *Attorney, Agent, or Firm*—Venable; James R. Burdett

(57) ABSTRACT

A shock sensor includes a casing defining a cylindrical space therein. The sensor also includes a protecting tube placed the cylindrical space so as to define an annular space between the casing and the protecting tube, the protecting tube having an inner space therein. A partitioning member is provided in the inner space so as to extend parallel to the longitudinal axis of the protecting tube and to divide the inner space into a plurality of compartments extending substantially parallel to the protecting tube. The sensor also includes a plurality of reed switches positioned one in each of the compartments, and insulating members placed in remaining spaces in the compartments. A magnetic actuating device for actuating the reed switches when a shock of predetermined magnitude acts on the sensor is slidably disposed on the protecting tube.

7 Claims, 7 Drawing Sheets

SHOCK SENSOR

BACKGROUND OF THE INVENTION

1. Field of the Invention

The present invention relates to shock sensors, more specifically to shock sensors and with reed switches.

2. Description of the Related Art

Shock sensors with reed switches are known. Since these sensors are used for automobile air-bag systems, for example, they must be highly reliable.

The shock sensor with reed switches comprises a casing in which a cylindrical tube is disposed. Two reed switches are placed in the tube with an annular space formed therebetween. An insulating medium such as thermosetting resin is injected into the space for preventing the reed switches from coming into contact with each other.

Annular magnetic actuating means such as an annular magnet is disposed in one end of the annular space so as to surround one end of the tube. The actuating means is arranged to move toward and away from the contacts of the reed switches under the force of a shock and the expansion and contraction of a spring.

In the process for manufacturing the sensor with reed switches, the reed switches are positioned in the inner space of the tube so as to extend parallel to the longitudinal axis of the tube and each other. Then, the raw material of the thermosetting resin is injected into the remaining space between the inner surface of the cylindrical tube and the reed switches.

However, it is difficult to maintain the reed switches in the initial position in which they are positioned in parallel relation to the longitudinal axis of the tube and each other during the injection of the raw material of the thermosetting resin. That is, they are easily replaced during the injection.

If either reed switch comes into contact with the other or with the inner surface of the tube during the injection, the glass tube of the reed switch may be damaged or broken.

Otherwise, the reed switches may be obliquely positioned with respect to the longitudinal axis of the cylindrical tube. Shock sensors with obliquely positioned reed switches have different operation characteristics from a normal one and from each other. In other words, shock sensors in which the reed switches are obliquely positioned operate at different shock forces. This is because the distance between the first position where the magnet is initially positioned and the second position where the magnet actuates the reed switches is different among such sensors.

SUMMARY OF THE INVENTION

It is an object of the present invention to provide shock sensors with reed switches wherein the reed switches are protected from damage and breakage during the manufacturing process.

It is another object of the present invention to provide shock sensors wherein the distance between the first position where the magnetic actuating means is initially positioned and the second position where the electromagnetic actuating means actuates the reed switches, is constant thereamong.

According to one aspect of the present invention, there is provided a shock sensor comprising a casing defining a cylindrical space therein, a protecting tube placed the cylindrical space so as to define an annular space between the casing and the protecting tube and having an inner space therein, a partitioning member provided in the inner space so as to extend parallel to the longitudinal axis of the protecting tube and to divide the inner space into a plurality of compartments extending substantially parallel to the protecting tube, a plurality of reed switches positioned one in each of the compartments, insulating members placed in remaining spaces in the compartments, and a magnetic actuating device provided in the annular space around the protecting tube for actuating the reed switches when a shock of predetermined magnitude acts on the sensor.

According to the first aspect of the present invention, the raw material for the insulating member is injected with the reed switches separately positioned in each of the compartments divided by the partitioning member. Therefore, the reed switches do not contact each other during injection. Accordingly, scratching or damaging of the closed glass tubes of the reed switches by contact therebetween is prevented to increase the production yield.

Further, according to the first aspect of the present invention, since each reed switch is positioned in a compartment extending substantially parallel to the longitudinal axis of the protecting tube along which the electrical actuating means moves, it is not significantly obliquely positioned during the injection of the raw material for the insulating member. Therefore, the operating characteristics become constant among a plurality of the sensors.

In the above shock sensor, the partitioning member may be a partitioning plate which divides the smaller space into two compartments and extends at a central portion of the inner space.

In the above shock sensor, the two compartments may be completely separated by the partitioning plate.

In the shock sensor thus constructed, the reed switches can be completely separated.

In the above shock sensor, the partitioning plate may be separately formed from the protecting tube.

According to the above shock sensor, the partitioning plate may integrally formed with the protecting tube.

In the shock sensor thus constructed, the number of the elements can be reduced and no step is needed for mounting the partitioning plate in the protecting tube.

In the above shock sensor, the partitioning member may include an opening fluidly connecting at least two of the compartments with each other.

In the shock sensor thus constructed, flowable raw material injected into one of the compartments can flow into the other compartment through the opening in the injecting operation. Since the injecting operation can therefore be completed by injection to one of the compartments, the productivity of the sensor is increased.

In the above shock sensor, the insulating members may be made of thermosetting resin.

In the above shock sensor, the opening may be located at one end of the partitioning plate.

According the another aspect of the present invention, there is provided a shock sensor comprising a casing defining a cylindrical space therein, a protecting device placed in the cylindrical space so as to define an annular space between the casing and the protecting device and having at least one elongated cylindrical space extending in parallel with the longitudinal axis of the protecting device, at least one reed switch received in the elongated space, and a magnetic actuating device provided in the annular space around the protecting tube for actuating the reed switch when a shock of predetermined magnitude acts on the sensor.

According to the second aspect of the present invention, since the reed switch is positioned in the compartment extending substantially parallel to the longitudinal axis of the protecting device, it is not significantly obliquely positioned during the injection of the raw material for the insulating member. Therefore, the operating characteristics become constant among a plurality of the sensors.

In the above shock sensor, an inner diameter of the elongate cylindrical space is slightly larger than an outer diameter of the reed switch.

In the shock sensor thus constructed, the reed switch is not obliquely positioned during the injection of the raw material for the insulating member. Therefore, the operating characteristics become constant among a plurality of the sensors.

In the above shock sensor, an insulating member may be provided between the reed switch and the protecting device.

In the above shock sensor, the insulating member may be made of thermosetting resin.

In the above shock sensor, the protecting device may comprise a protecting tube and a protecting member placed in the protecting tube and the elongated cylindrical space be formed in the protecting member.

In the above shock sensor, a plurality of the elongated cylindrical spaces may be formed in the protecting member.

In the above shock sensor, at least two of the elongated cylindrical spaces may be fluidly connected by a passage means.

In the shock sensor thus constructed, flowable raw material injected into one of the cylindrical spaces can flow into the other cylindrical space through the passage means in the injecting operation. Since the injecting operation can therefore be completed by injection to one of the cylindrical spaces, the productivity of the sensor is increased.

In the above shock sensor, an auxiliary recess for receiving a lead wire may be formed in the insulating member so as to extend along the elongated cylindrical space.

BRIEF DESCRIPTION OF THE DRAWINGS

The foregoing and other objects, features and advantages of the present invention will be better understood from the following description taken in conjunction with the accompanying drawings, in which.

DETAILED DESCRIPTION OF THE PREFERRED EMBODIMENTS

Figure 1:
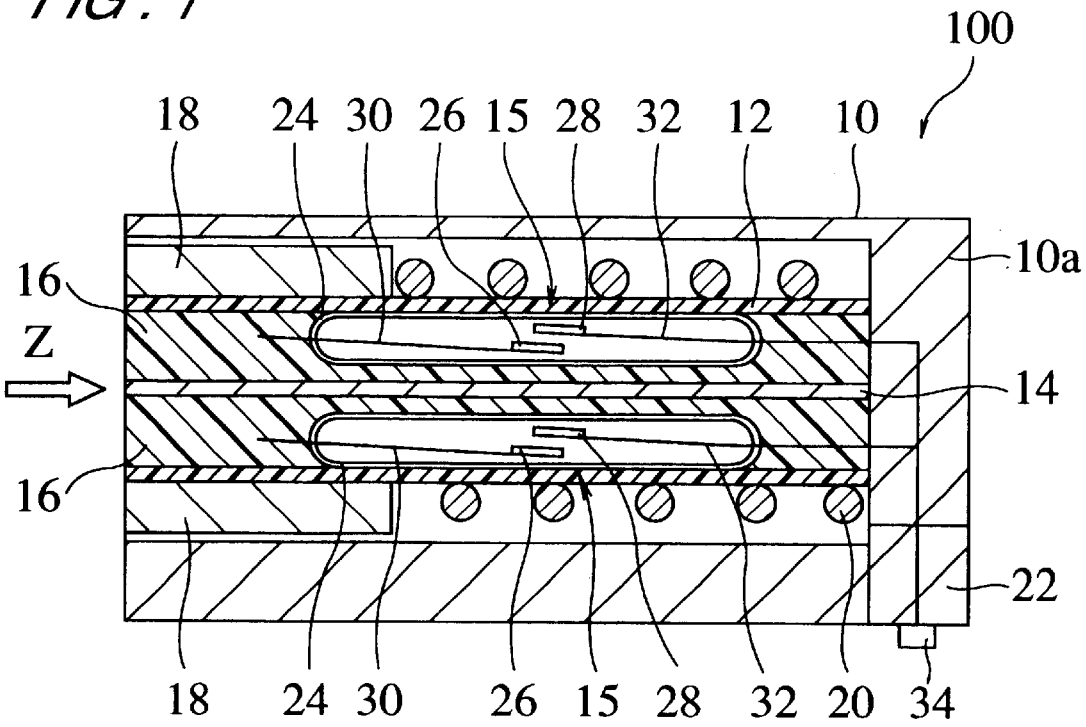
FIG. 1 is a schematic cross-sectional view of a sensor according to a first embodiment of the present invention, taken along the longitudinal axis of the sensor.

Preferred embodiments according to the present invention will be described hereunder in detail with reference to the accompanying drawings.

In the accompanying drawings, the respective elements of the embodiment are illustrated schematically to the extent that the shape, the size and the positional relationship thereof can be understood. Accordingly, the present invention is not limited to the illustration of the drawings. Further, the same or similar elements in the drawings are designated by the same reference numerals, and duplicative description thereof is omitted.

First Embodiment

Figure 2:
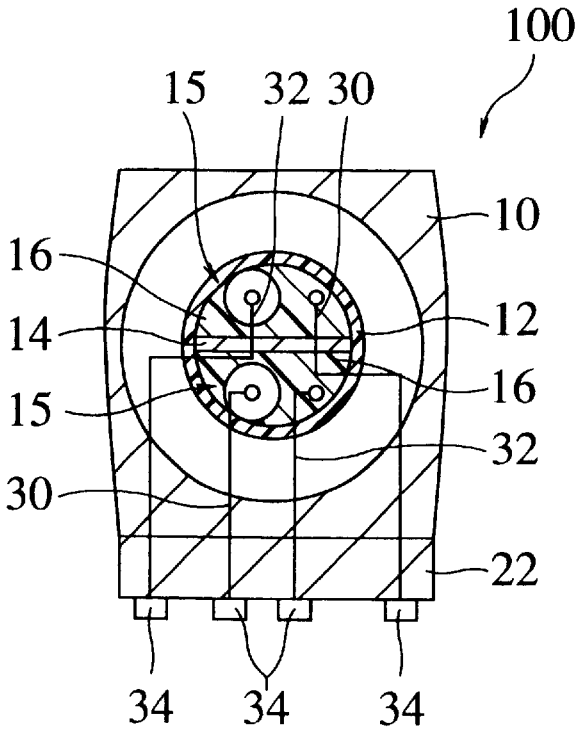
FIG. 2 is a schematic diagram showing the positional relationship of the elements in the sensor shown in FIG. 1, seen from one end thereof along the longitudinal axis thereof.

FIG. 1 is a schematic cross-sectional view of a sensor 100 according to a first embodiment of the present invention, taken along the longitudinal axis of the sensor, and FIG. 2 is a schematic diagram showing the positional relationship of the elements in the sensor 100 shown in FIG. 1, seen from one end thereof along the longitudinal axis thereof.

As shown in FIGS. 1 and 2, the sensor 100 comprises a hollow casing 10 with a cylindrical space therein, one end of which is closed by a bottom wall 10*a*.

The sensor 100 includes a protecting tube 12. The protecting tube 12 is disposed in the cylindrical space of the casing 10 so as to form an annular space between the inner surface of the casing 10 and the outer surface of the protecting tube 12. The protecting tube 12 has an inner space which has a generally circular shape in cross-section, as shown in FIG. 2. The protecting tube 12 is preferably made of plastic material.

A partitioning member 14 is disposed in the inner space of the protecting tube 12. The partitioning member 14 is a plate member having an elongated generally rectangular shape and substantially the same length as the axial length of the inner space of the protecting tube 12. The partitioning member (plate) 14 can be formed separately from the protecting tube 12 and mounted in protecting tube 12 so as to extend along the longitudinal axis of the protecting tube at the vertically central position of the inner space and to divide the inner space into two compartments. Therefore, the two compartments are substantially completely separated by the partitioning member (plate) 14 and extend substantially parallel to the longitudinal axis of the protecting tube 12. Each of the compartments is large enough to receive a reed switch. Alternatively, the partitioning member 14 can be formed integrally with the protecting tube 12.

Reed switches 15, 15 are disposed one in each of the compartments, respectively so as to extend in parallel relation to the longitudinal axis of the protecting tube 12. That is, the reed switches 15, 15 are similarly positioned in their respective compartments. The remaining spaces in the two compartments are filled with insulating members 16, 16. The insulating members 16, 16 are made of electrically insulating material, such as thermosetting resin. The insulating members 16, 16 are formed in the compartments by injecting the flowable raw material of the insulating members 16, 16 thereinto, with each of the reed switches 15, 15 set in place in its compartment.

An annular magnet 18 is disposed in an initial position adjacent to an end of the annular space opposite to the end closed by the bottom wall 10*a*, so as to surround one end of the protecting tube 12 and to be slidable along the outer surface of the protecting tube 12.

A compression spring 20 is interposed between the annular magnet 18 and the bottom wall 10*a* of the casing 10. The compression springs 20 urges the annular magnet 18 to normally place it in an initial position adjacent to the open end of the annular space. The shock sensor 100 is arranged such that the annular magnet 18 is forcibly moved toward the opposite end of the annular space against the resilient force of the compression spring 20 when a shock acts on the sensor 100 from the direction indicated by an arrow Z.

A terminal plate 22 is formed as a part of the bottom wall 10*a* of the casing 10.

The reed switches 15, 15 are of the well-known type including a closed glass tube 24 filled with inert gas and a pair of reeds 26, 28 disposed in the closed glass tube 24 and connected at one end to the lead wires 30, 32, respectively. The reeds 26, 28 are positioned in the closed glass tube 24 so as to face with each other. More specifically, the reeds 26, 28 are arranged to take a disconnected (off position where they are separated from each other when they are not magnetized and to take a connected (on) position where they are in contact with each other when they are magnetized.

In the sensor 100, each reed switch 15 is positioned in the protecting tube such that the reeds 26, 28 in the reed switch 15 are not magnetized when the annular magnet 18 is in the initial position and are magnetized when the annular magnet 18 is moved along the protecting tube 12 to a predetermined position against the resilient force of the compression spring 20 by a shock.

The lead wire 30 extending from the reed 26 passes through the wall of the closed glass tube 24 into the insulating member 16 toward the one end of the sensor 100 where the magnet 18 is located. The lead wire 30 then turns toward the opposite end of the sensor 100, where the terminal plate 22 is located and extends through the insulating member 16 and the bottom wall 10*a* of the casing 10 to the terminal plate 22. Finally, the lead wire 30 is connected to an electrical circuit (not shown), for example that of an air-bag system, via a terminal 34 provided on the terminal plate 22.

The lead wire 32 extending from the reed 28 passes through the wall of the closed glass tube 24, through the insulating member 16 and then the bottom wall 10*a* of the casing 10 to the terminal plate 22. Finally, the lead wire 32 is also connected to the electrical circuit (not shown), for example that of an air-bag system, via a terminal 34.

Figure 3A:
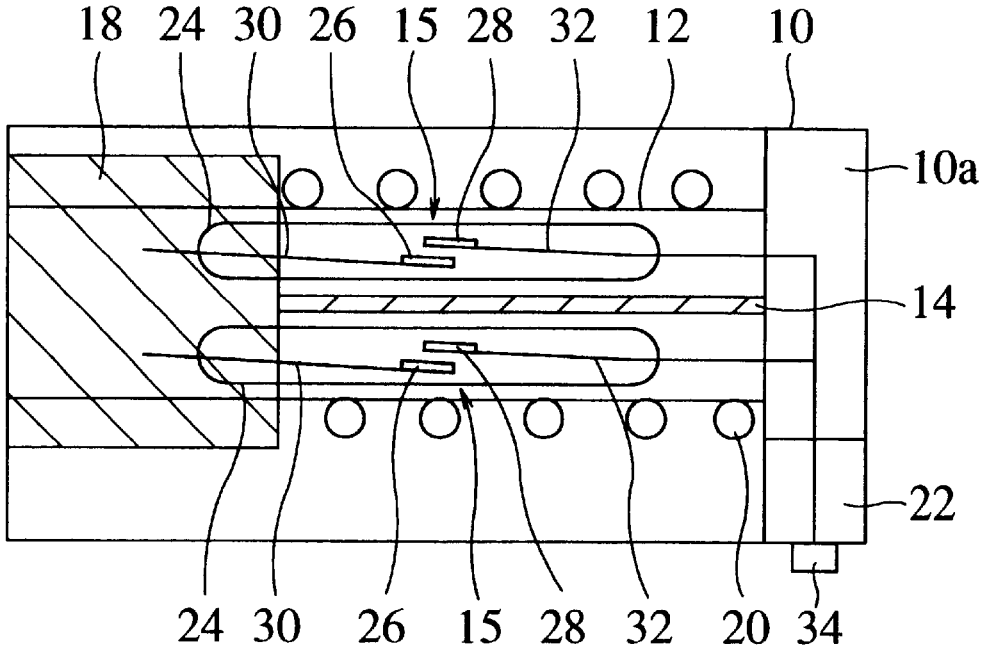
FIGS. 3A and 3B are schematic diagrams for explaining the operation of the sensor shown in FIGS. 1 and 2, wherein FIG. 3A schematically shows the sensor in cross-section when no shock acts thereon and FIG. 3B schematically shows the sensor in cross-section when shock acts thereon.

The sensor 100 thus constructed operates as follows:

The annular magnet 18 is normally placed in the initial position at the end of the annular space between the inner surface of casing 10 and the outer surface the protecting tube 12 by the force of the compression spring 20, as shown in FIG. 3(A). Therefore, the reeds 26, 28 are not magnetized by the annular magnet 18 so that they are in the disconnected (off) position. Thus, the sensor 100 is normally non-conductive.

Figure 3B:
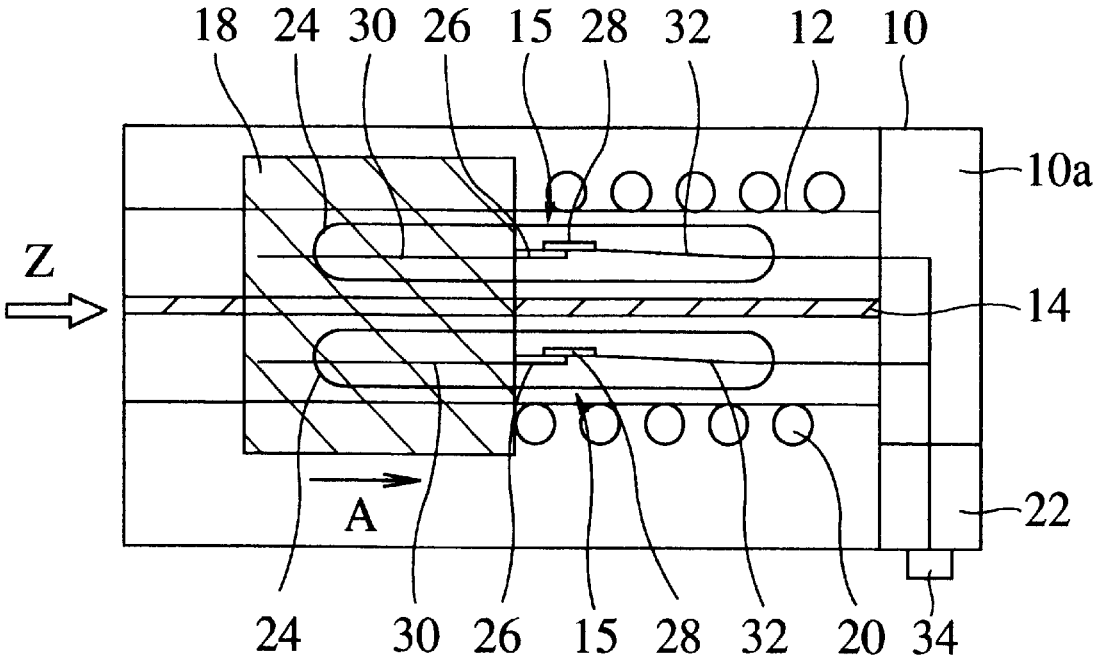

When a shock acts on the sensor 100 from the direction indicated by the arrow Z, the annular magnet 18 moves from its initial position in the direction indicated by an arrow A toward the bottom wall 10*a* of the casing 10 against the force of the compression spring 20 and thus approaches the reeds 26, 28 of the reed switches 15, 15. When the shock is large enough to move the annular magnet 18 to the predetermined position where the annular magnet 18 can magnetize the reeds 26, 28, they are magnetized and move toward each other into the connected (on) position, as shown in FIG. 3(B). The reed switch 15 therefore becomes conductive. Thus, current flows through the reed switch 15 and the shock can be sensed.

Thereafter, when the shock subsides, the annular magnet 18 returns to the initial position where the magnetic force thereof does not affect the reeds 26, 28. Therefore, the reeds 26, 28 move away from each other into the disconnected position, whereby the reed switch 15 becomes non-conductive.

According to the sensor 100 of the first embodiment of the present invention, since the injection of the raw material of the insulating member is carried out with the reed switches 15, 15 separately positioned in the compartments, the reed switches 15, 15 do not contact each other during the injection. Since the reed switches 15, 15 therefore do not come into contact with each other, scratching or damaging of the closed glass tube 24 of the reed switches 15 by the contact therebetween is prevented to increase the production yield.

Further, according to the sensor 100, since each of the reed switches is positioned in a compartment extending substantially parallel to the longitudinal axis of the protecting tube 12 along which the annular magnet 18 moves, neither of the reed switches 15, 15 is significantly obliquely positioned during the injection of the raw material for the insulating member 16. Therefore, the operating characteristics become constant among a plurality of the sensors.

Second Embodiment

Figure 4:
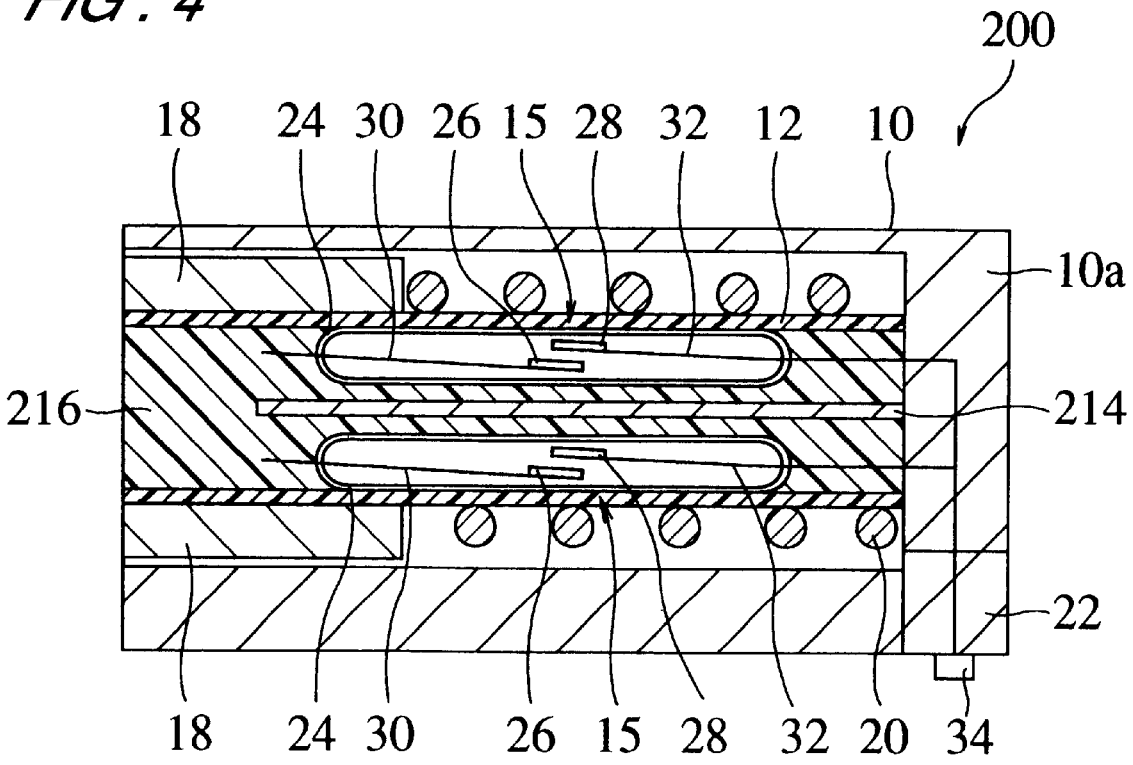
FIG. 4 is a schematic cross-sectional view of a sensor according to a second embodiment of the present invention, taken along the longitudinal axis thereof.

FIG. 4 is a schematic cross-sectional view of a sensor 200 according to a second embodiment of the present invention, taken along the longitudinal axis thereof.

As shown in FIG. 4, the sensor 200 of the second embodiment is substantially the same as the sensor 100 of the first embodiment in construction. Elements like those of the first embodiment are represented by the same reference numerals and the description thereof is omitted.

The sensor 200 differs from the sensor 100 in that the partitioning member 214 in sensor 200 includes an opening 216 so that the two compartments are fluidly connected with each other. More specifically, the opening 216 is provided by cutting off a part of the partitioning member 214 at one end thereof. The sensor 200 operates similarly to the sensor 100.

According to the sensor 200 of the second embodiment of the present invention, since there is provided the opening 216 fluidly connecting the two compartments with each other, flowable raw material injected into one of the compartments can flow into the other compartment through the opening 216 in the injecting operation. Since the injecting operation can therefore be completed by injection into one of the compartments, the productivity of the manufacturing process for the sensor is increased.

Alternatively, the opening can be provided by boring through holes in a partitioning plate which completely separates the two compartment like the partitioning plate 14 of the sensor 100.

Third Embodiment

Figure 5:
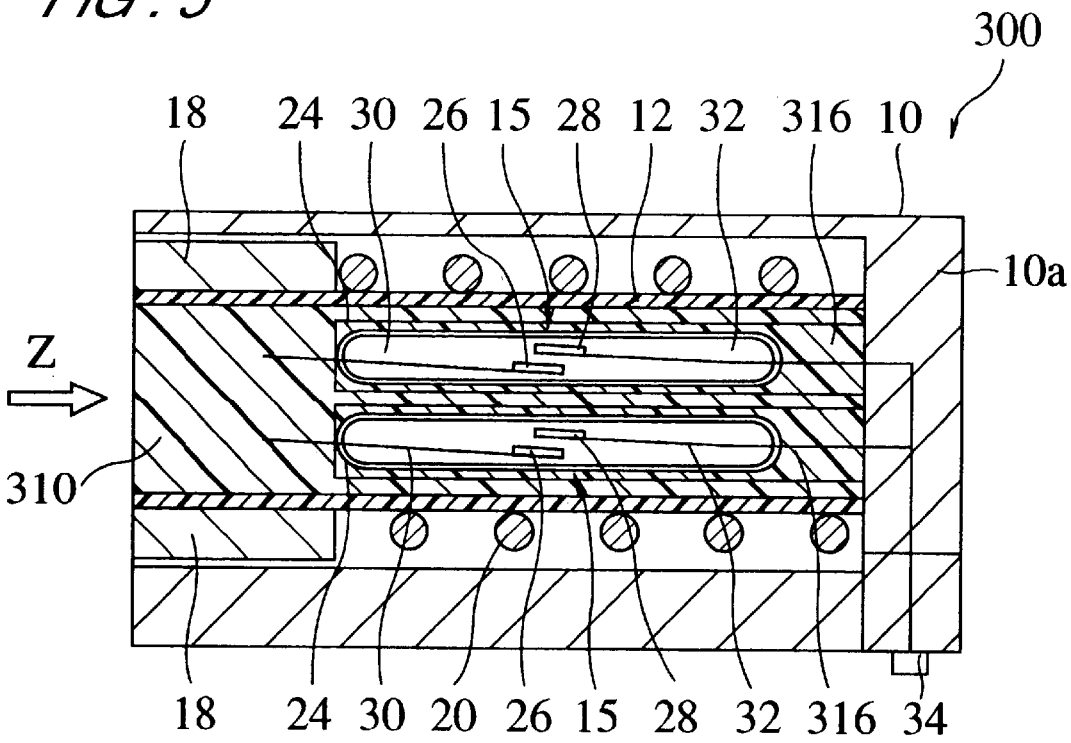
FIG. 5 is a schematic cross-sectional view of a sensor according a third embodiment of the present invention, taken along the longitudinal thereof.
Figure 6:
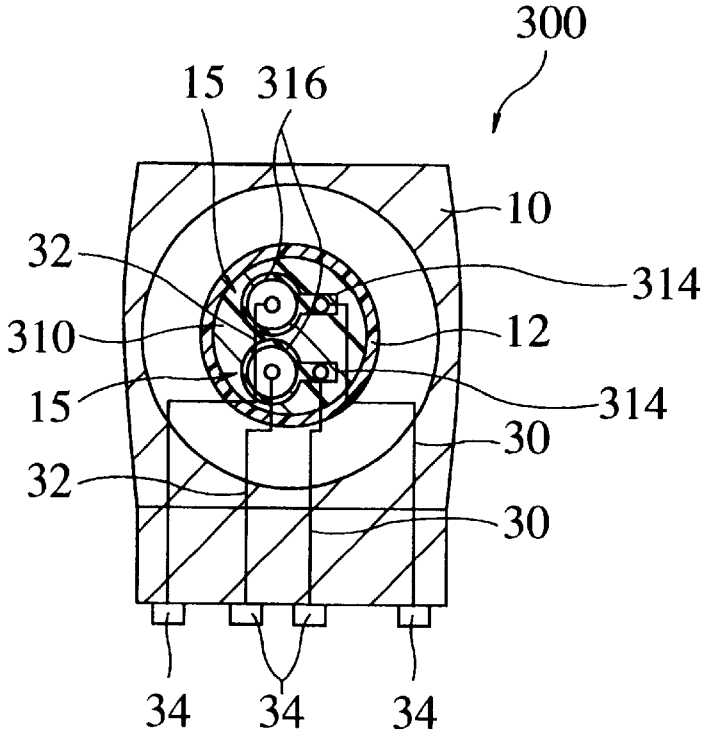
FIG. 6 is a schematic diagram showing the positional relationship between the elements in the sensor shown in FIG. 5, seen from one end of the sensor along the longitudinal axis thereof.

FIG. 5 is a schematic cross-sectional view of a sensor 300 according a third embodiment of the present invention, taken along the longitudinal axis thereof, and FIG. 6 is a schematic diagram showing the positional relationship between the elements in the sensor 300 shown in FIG. 5, seen from one end the sensor along the longitudinal axis thereof.

As shown in FIGS. 5 and 6, the sensor 300 of the third embodiment is basically the same as the sensor 100 of the first embodiment in construction. Elements like those of the first embodiment are represented by the same reference numerals and the description thereof is omitted.

The sensor 300 differs from the sensor 100 in that it is provided with a protecting member 310 as a partitioning member in addition to the protecting tube 12.

The partitioning member 310 has a cylindrical shape whose outer diameter is substantially same as the inner diameter of the protecting tube 12 and whose length is substantially same as the length of the cylindrical inner space of the protecting tube 12. Thus, the protecting member 310 occupies in the inner space of the protecting tube 12. The protecting member 310 is preferably made of plastic material. In the sensor 300, the protecting tube 12 and the protecting member 310 constitute a protecting device.

The protecting member 310 has an inner wall which defines a pair of elongated cylindrical spaces therein. The cylindrical spaces 312 extend in parallel relation to the longitudinal axis of the protecting tube 12 and are completely separated from each other. The inner diameter of each cylindrical space 312 is slightly larger than the outer diameter of the reed switch 15 and the length thereof is set larger than that of the reed switch 15.

The inner wall of the protecting member 310 also defines a pair of auxiliary recess 314 having a rectangular shape in cross-section, each of which is fluidly connected to one of the cylindrical spaces 312, 312 and extends along the entire length of the cylindrical spaces 312, 312. The sectional area of the auxiliary recess is preferably smaller than that of the elongated cylindrical space 312. However, each of the auxiliary recesses 314, 314 is dimensioned so as to receive a lead wire 30.

The two reed switches 15, 15 are positioned in the protecting member 310 with the closed glass tubes 24 inserted into the elongated cylindrical spaces 312, 312 and the lead wires 30, 30 received in the auxiliary recess 314.

The remaining spaces in the elongated cylindrical spaces 312, 312 and the auxiliary recesses 314, 314 are filled with insulating members 316, 316. The insulating members 316, 316 are made of an electrically insulating material, such as thermosetting resin. The insulating members 316, 316 are placed in these spaces by injecting the flowable raw material for the insulating members 316, 316 thereinto, with the reed switches 15, 15 positioned in their respective places.

The sensor 300 operates similarly to the sensor 100.

According to the sensor 300 of the third embodiment of the present invention, since the injection of the raw material for the insulating member is carried out with the reed switches 15, 15 separately positioned in the elongated cylindrical spaces in the protecting member 310, the reed switches 15, 15 do not contact each other during the injection. Therefore, the reed switches 15, 15 do not come into contact with each other so that scratching or damaging of the closed glass tubes 24 of the reed switches 15 by contact therebetween is prevented to increase the yield rate.

Further, according to the sensor 300, since each of the reed switches 15, 15 is positioned in an elongated cylindrical space defined in the protecting member and extending substantially parallel to the longitudinal axis of the protecting tube 12 along which the annular magnet 18 moves, neither of the reed switches 15, 15 is significantly obliquely positioned during the injection of the raw material for the insulating member 316. Therefore, the operating characteristics become constant among a plurality of the sensors.

In the manufacturing process, the reed switches 15, 15 may be inserted in the their respective compartments after the injection of the thermosetting resin thereinto.

Alternatively, there may be provided a connecting path between the elongated cylindrical spaces.

Figure 7:
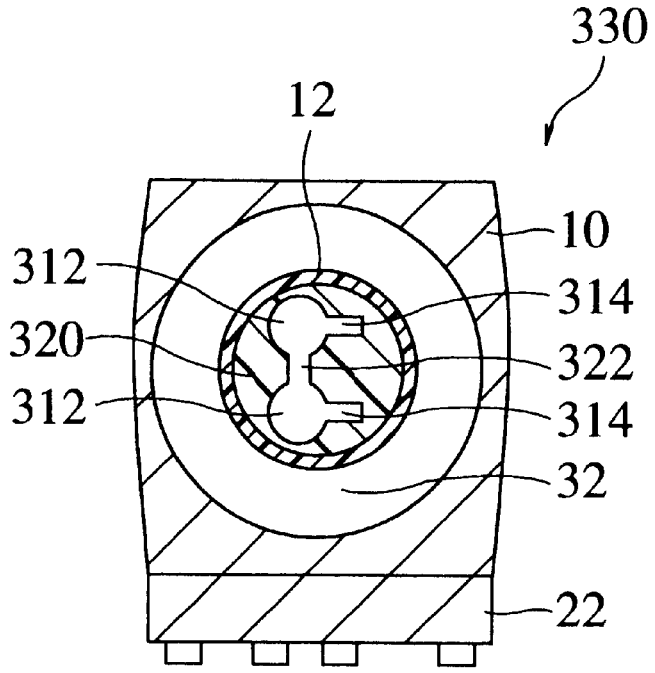
FIG. 7 is a schematic cross-sectional view showing a cross-sectional shape of a protecting member provided in a sensor according to a modification of the third embodiment of the present invention.
Figure 8:
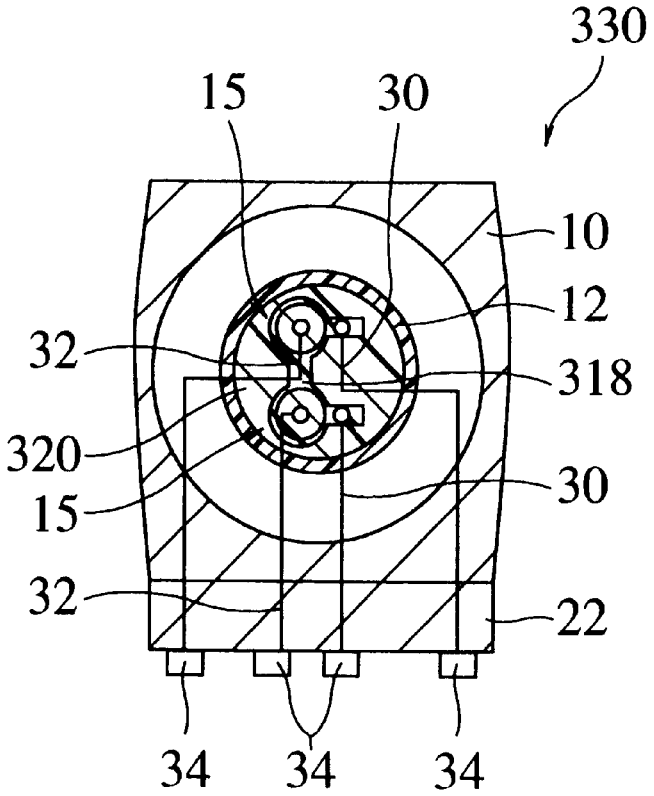
FIG. 8 is a schematic cross-sectional view of the sensor shown in FIG. 7, after installing the reed switches.

FIG. 7 is a schematic cross-sectional view showing the cross-sectional shape of a protecting member 320 provided in a sensor 330 according to a modification of the third embodiment of the present invention and FIG. 8 is a schematic cross-sectional view of the sensor 330 shown in FIG. 7, after installing the reed switches 15, 15.

As shown in FIGS. 7 and 8, in the sensor 330 according to the modification of the sensor 300, there is provided a passage means or a connecting path 322 fluidly connecting the elongated cylindrical spaces 312, 312. The connecting path 322 has a smaller width than the outer diameter of the reed switch 15 (or closed glass tube 24) and extends the entire length of the elongated cylindrical space 312. The connecting path 322 is to be filled with the raw material for the insulating member 318.

According to the sensor 330 of the modification, since there is provided the connecting path 322 fluidly connecting the two elongated cylindrical spaces in which the reed switches are positioned, flowable raw material injected into one of the elongated spaces can flow into the other elongated space through the connecting path 322 in the injecting operation. Since the injecting operation can therefore be completed by injection to one of the elongated cylindrical spaces, the productivity of the manufacturing process for the sensor is increased.

Fourth Embodiment

Figure 9:
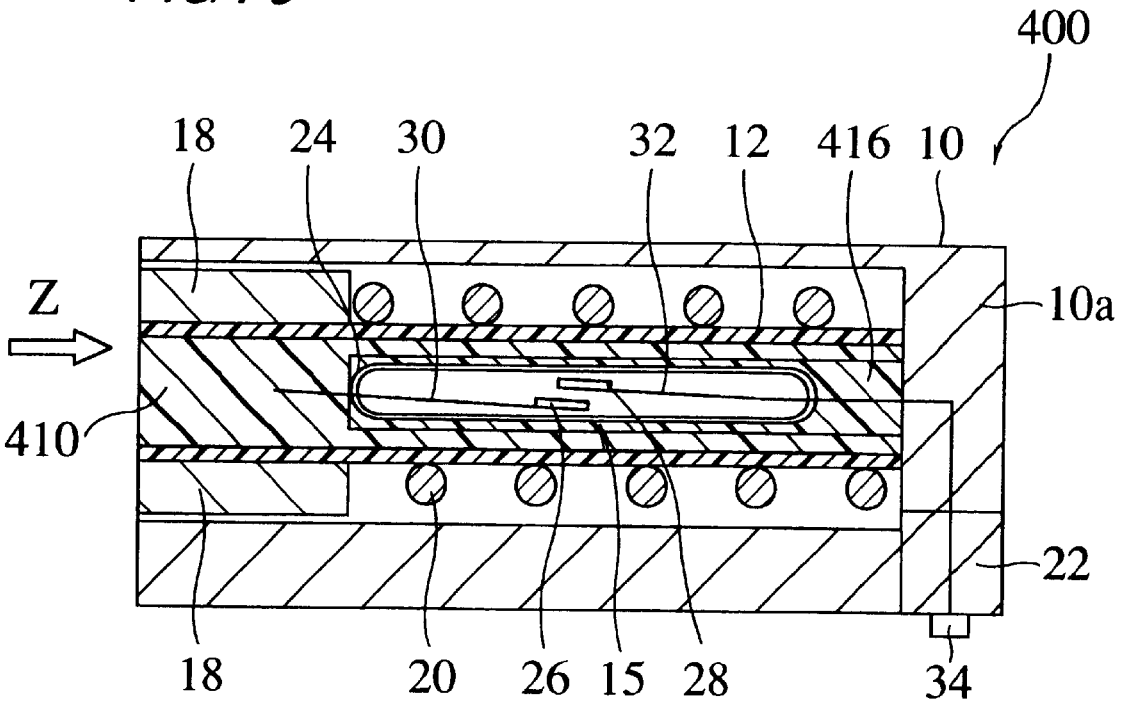
FIG. 9 is a schematic cross-sectional view of a sensor according to a fourth embodiment of the present invention, taken along the longitudinal thereof.
Figure 10:
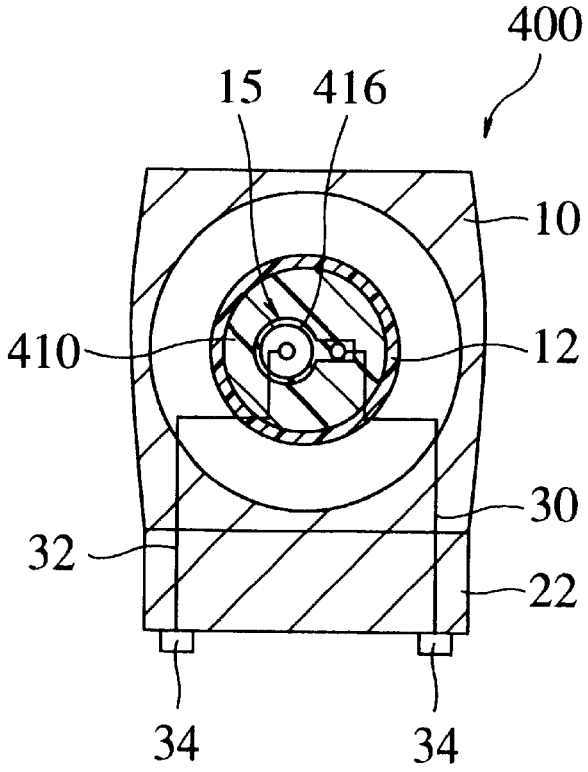
FIG. 10 is a schematic diagram showing the positional relationship between the elements in the sensor shown in FIG. 9, seen from one end of the sensor along the longitudinal axis thereof.

FIG. 9 is a schematic cross-sectional view of a sensor according to a fourth embodiment of the present invention, taken along the longitudinal thereof, and FIG. 10 is a schematic diagram showing the positional relationship between the elements in the sensor shown in FIG. 9, seen from the one end of the sensor along the longitudinal axis thereof.

As shown in FIGS. 9 and 10, the sensor 400 of the fourth embodiment is basically the same as the sensor 300 of the third embodiment in construction. Elements like those of the third embodiment are represented by the same reference numerals and the description thereof is omitted.

The sensor 300 differs from the sensor 400 in that the sensor 400 comprises only one reed switch 15 (furthermore, in a modification the sensor 400 may omit the protecting tube 12).

Therefore, the protecting member 410 has only one elongated cylindrical space therein. The reed switch 15 is positioned in the protecting member 410 with the closed glass tube 24 of the reed switch 15 is inserted into the elongated cylindrical space and the lead wire 30 received in the auxiliary recess.

The remaining space in the elongated cylindrical space and the auxiliary recess is filled with insulating member 416. The insulating member 416 is made of electrically insulating material, such as thermosetting resin. The insulating member 16 is placed in the space by injecting the flowable raw material for the insulating member 416 thereinto, with the reed switch 15 positioned in place.

The sensor 400 operates similarly to the sensor 100.

According to the sensor 400 of the fourth embodiment of the present invention, since the reed switch 15 is positioned in the elongated cylindrical space defined in the protecting member and extending substantially parallel to the longitudinal axis of the protecting member 410 along which the annular magnet 18 moves, the reed switch 15 is not significantly obliquely positioned during the injection of the raw material for the insulating member 416. Therefore, the operating characteristics become constant among a plurality of the sensors.

Alternatively, the terminal board 22 may omitted from the sensor 400.

Figure 11:
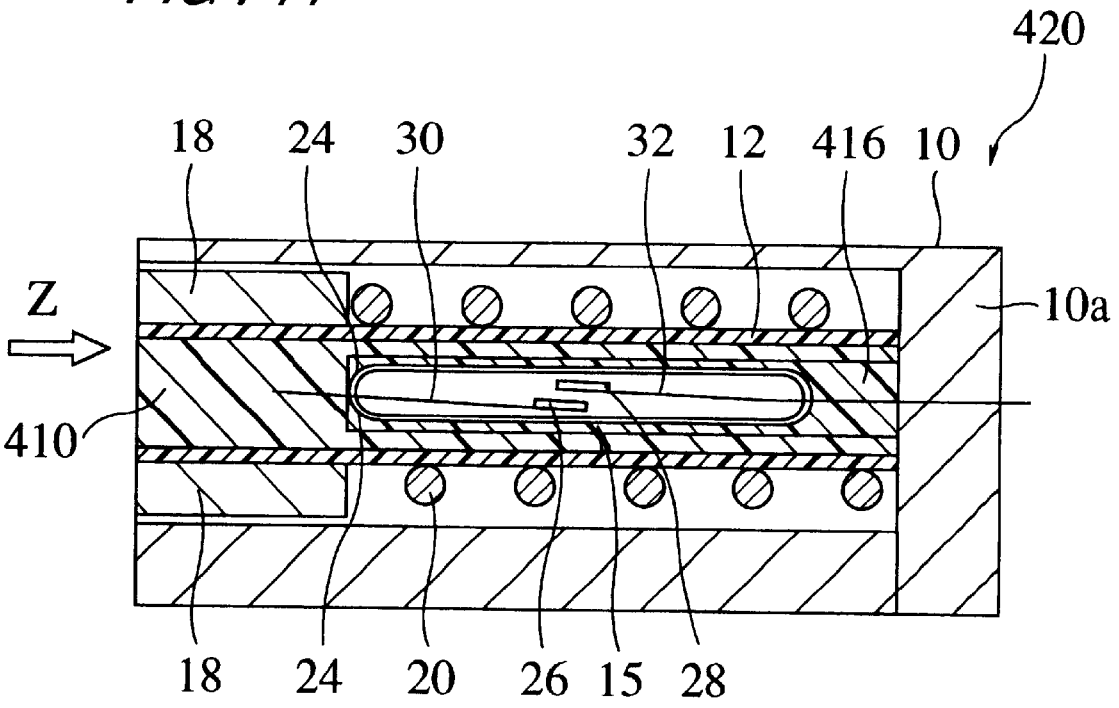
FIG. 11 is a schematic cross-sectional view of a sensor according to a modification of the fourth embodiment of the present invention, taken along the longitudinal axis thereof.
Figure 12:
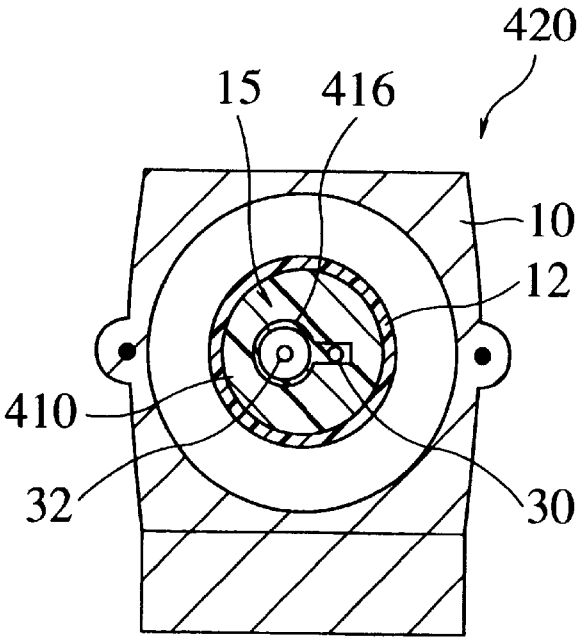
FIG. 12 is a schematic diagram showing the positional relationship between the elements in the sensor shown in FIG. 11, seen from one end of the sensor along the longitudinal axis thereof.

FIG. 11 is a schematic cross-sectional view of a sensor 420 according to another example of the fouth embodiment of the present invention, taken along the longitudinal axis thereof, and FIG. 12 is a schematic diagram showing the positional relationship between the elements in the sensor 420 shown in FIG. 11, seen from one end of the sensor along the longitudinal axis thereof.

The sensor 420 differs from the sensor 400 in that the sensor 420 has no terminal plate. The lead wire therefore extends directly through the bottom wall 10*a*.

In the above sensors, a permanent magnet or electromagnet is preferably used as the annular magnet. Further, in the above sensors, thermosetting resin is used for forming the insulating member. However, other curable material can be used for the insulating member.

While the invention has been described with respect to preferred embodiments, it is to be understand that the invention is capable of numerous modifications, rearrangements, and changes that are within the scope of the invention as defined by the appended claims.

What is claimed is:

1. A shock sensor comprising:

a casing having a cavity therein;

a protecting tube placed in said cavity so as to define an annular space between said casing and said protecting tube;

a protecting member in said protecting tube, said protecting member having an elongated space extending substantially parallel with the longitudinal axis of said protecting tube;

a reed switch received in said elongated space;

resin injected into said elongated space to form a resin body, said reed switch being embedded in said resin body; and a magnetic actuating device provided in said annular space around the said protecting tube for actuating said reed switch when a shock of a predetermined magnitude is applied to the sensor.

2. A shock sensor as claimed in claim 1, wherein said elongate space has an inner diameter that is slightly larger than an outer diameter of said reed switch.

3. A shock sensor as claimed in claim 1, wherein an additional elongated space is formed in said protecting member, and further comprising an additional reed switch and an additional resin body in said additional elongated space.

4. A shock sensor as claimed in claim 3, wherein said elongated spaces are fluidly connected by a passage means.

5. A shock sensor as claimed in claim 1, wherein an auxiliary recess for receiving a lead wire is formed in said resin body so as to extend along said elongated space.

6. A shock sensor comprising:

a casing having a cavity therein;

a protecting device having a longitudinal axis and having at least one elongated space extending substantially parallel to the longitudinal axis, the protecting device being mounted in the cavity and at least part of the protecting device being surrounded by a space between the casing and the protecting device;

at least one reed switch received in the at least one elongated space;

resin injected between the protecting device and the at least one reed switch to form at least one insulating member in which the at least one reed switch is embedded; and a magnetic actuating device in the space between the casing and the protecting device for actuating the at least one reed switch when a shock of a predetermined magnitude is applied to the sensor, wherein the protecting device comprises a protecting tube and a protecting member placed in the protecting tube, the at least one elongated space being provided in the protecting member.

7. A shock sensor as claimed in claim 6, wherein the at least one elongate space has an inner diameter that is slightly larger than an outer diameter of the at least one reed switch.

* * * * *